US008801284B2

(12) United States Patent
Croibier et al.

(10) Patent No.: US 8,801,284 B2
(45) Date of Patent: Aug. 12, 2014

(54) FLUID DISPENSER

(71) Applicant: Aptar France S.A.S., Le Neubourg (FR)

(72) Inventors: Denis Croibier, Berou la Mulotiere (FR); Christophe Pierre, Saint-Sebastien-de-Morsent (FR)

(73) Assignee: Aptar France SAS, Le Neubourg (FR)

( * ) Notice: Subject to any disclaimer, the term of this patent is extended or adjusted under 35 U.S.C. 154(b) by 0 days.

(21) Appl. No.: 13/655,113

(22) Filed: Oct. 18, 2012

(65) Prior Publication Data

US 2013/0094785 A1 Apr. 18, 2013

Related U.S. Application Data

(60) Provisional application No. 61/552,583, filed on Oct. 28, 2011.

(30) Foreign Application Priority Data

Oct. 18, 2011 (FR) ..... 11 59392

(51) Int. Cl.

| | |
|---|---|
| ***B65D 33/14*** | (2006.01) |
| ***B65D 33/10*** | (2006.01) |
| ***B65D 33/16*** | (2006.01) |
| ***B65D 35/00*** | (2006.01) |
| ***B65D 47/00*** | (2006.01) |

(52) U.S. Cl.

USPC ..... 383/5; 383/9; 383/61.1; 383/80; 383/906; 222/92; 222/106; 222/107; 222/556

(58) Field of Classification Search

USPC ..... 383/80, 61.1, 906, 5, 9; 222/92, 106, 222/107, 546, 554, 556, 557

See application file for complete search history.

(56) References Cited

U.S. PATENT DOCUMENTS

| | | | | |
|---|---|---|---|---|
| 6,142,341 | A | 11/2000 | Uematsu | |
| RE39,520 | E * | 3/2007 | Hess et al. | 222/92 |
| 8,028,860 | B2 * | 10/2011 | Seelhofer | 222/107 |
| 2003/0075560 | A1 * | 4/2003 | Lee | 222/92 |
| 2010/0086243 | A1 * | 4/2010 | Takeda et al. | 383/105 |

FOREIGN PATENT DOCUMENTS

| | | | | |
|---|---|---|---|---|
| DE | 198 24 738 | A1 | 12/1999 | |
| EP | 1 958 888 | A1 | 8/2008 | |
| FR | 2 754 246 | A1 | 4/1998 | |
| WO | WO 2004054888 | A1 * | 7/2004 | B65D 33/28 |

OTHER PUBLICATIONS

Machine translation of French Document No. 2 754 246. Translated on Dec. 7, 2013.*
French Search Report for FR 1159392 dated Apr. 26, 2012.
French Written Opinion for FR 1159392 dated Oct. 18, 2011.

* cited by examiner

*Primary Examiner* — Jes F Pascua
(74) *Attorney, Agent, or Firm* — Sughrue Mion, PLLC

(57) ABSTRACT

A fluid dispenser comprising:

a flexible pouch (1) that comprises two flexible sheets (11, 12) that define between them a fluid reservoir (10) and an opening (14); and a stopper-and-dispenser member (2) that is mounted in stationary, permanent, and leaktight manner in the opening (14) of the pouch (1), the stopper member (2) including a body (3) that defines a dispenser orifice (34) and two sealing zones (31*c*, 31*d*), respectively for the two flexible sheets (11, 12) of the pouch (1);

the dispenser being characterized in that the stopper-and-dispenser member (2) further includes a closure lid (4) for closing the dispenser orifice (34), the lid (4) being hinged (43) on the body (3) in such a manner as to pivot between a closed position and an open position.

16 Claims, 4 Drawing Sheets

FLUID DISPENSER

CROSS REFERENCE TO RELATED APPLICATION

This application claims the benefit under 35 U.S.C. §119 (e) of pending U.S. provisional patent application Ser. No. 61/552,583, filed Oct. 28, 2011, and priority under 35 U.S.C. §119(a)-(d) of French patent application No. FR-11.59392, filed Oct. 18, 2011.

TECHNICAL FIELD

The present invention relates to a fluid dispenser comprising a stopper-and-dispenser member that is associated with a flexible pouch that defines a fluid reservoir and an opening in which the stopper-and-dispenser member is mounted in stationary, permanent, and leaktight manner. The flexible pouch generally comprises two flexible sheets that are sealed in leaktight manner on two respective sealing zones that are formed by the stopper-and-dispenser member. The stopper-and-dispenser member includes an outlet channel that connects the reservoir of the pouch to a dispenser orifice. Such a fluid dispenser finds an advantageous application in the fields of cosmetics, pharmacy, or even perfumery. However, the fields of foodstuffs or household cleaners are not excluded.

BACKGROUND OF THE INVENTION

This type of fluid dispenser is often used as a sample with a small quantity of fluid stored in the reservoir. The dispenser generally presents a configuration that is relatively flat or plane so that it extends mainly in a plane. The two flexible sheets of the pouch are spaced apart a little, usually by a distance that corresponds to the thickness of the stopper-and-dispenser member.

Particularly when it is used as a sample, the dispenser is opened in such a manner as to uncover the dispenser orifice. Then, the user squeezes manually on the reservoir so as to force the fluid through the outlet channel so as to be collected at the dispenser orifice. Usually, this type of dispenser is a single-use dispenser, with the user throwing the dispenser away after emptying the reservoir.

In the prior art, dispensers already exist having a dispenser orifice that is closed by a closure element that may be made by an extension of the two flexible sheets. Alternatively, a small pull-off tab may be provided that initially covers the dispenser orifice. However, as a result of it being a dispenser that is nearly always used once only, that type of dispenser is rarely provided with a repositionable closure member.

BRIEF SUMMARY OF THE INVENTION

An object of the present invention is to remedy the above-mentioned drawback of the prior art by defining a fluid dispenser having a dispenser orifice that may easily be uncovered, and then closed once again, and to do so repeatedly.

To achieve this object, the present invention proposes a fluid dispenser comprising: a flexible pouch that comprises two flexible sheets that define between them a fluid reservoir and an opening; and a stopper-and-dispenser member that is mounted in stationary, permanent, and leaktight manner in the opening of the pouch, the stopper member including a body that defines a dispenser orifice, an outlet channel that connects the reservoir to the dispenser orifice, and two sealing zones, respectively for the two flexible sheets of the pouch; the dispenser being characterized in that the stopper-and-dispenser member further includes a closure lid for closing the dispenser orifice, the lid being hinged on the body in such a manner as to pivot between a closed position and an open position. The use of a pivotable closure lid is completely unusual for this type of dispenser presenting an extremely flat configuration. With the pivotable closure lid, it is very easy to uncover the dispenser orifice, and to close it once again, and to do so repeatedly.

According to an advantageous characteristic of the present invention, the body defines an internal edge face that is arranged inside the reservoir, and an external edge face, the outlet channel extending from the internal edge face to the external edge face in which the dispenser orifice is formed, the sealing zones extending between the two edge faces, the lid being hinged on the external edge face. Thus, the closure lid is arranged outside the opening of the pouch. Preferably, the external edge face includes two longitudinal side edges that are joined together at two opposite ends, the lid being hinged at one of the ends. As a result, the closure lid pivots in the plane of the dispenser. Alternatively, the lid is hinged at one of the two longitudinal side edges. In a practical embodiment, the external edge face is formed by an elongate bar that is arranged other than at the opening. Advantageously, the lid covers all of the external edge face in the closed position. In a practical aspect, the dispenser orifice is formed by a projecting stud, and the lid includes a recess in which the stud is received in leaktight manner in the closed position.

In another advantageous aspect of the present invention, the lid is provided with a first-use safety element that is initially connected to the lid before the stopper member is opened for the first time, and that is separated from the lid while the stopper member is being opened for the first time, the safety element being sealed to the pouch and/or to the body of the stopper member while the stopper member is being sealed in the opening of the pouch. The first-use safety element may be in the form of a stem, a tab, a leaf, etc. that extends freely from the lid and that is sealed to the pouch and/or to the body of the stopper member, so that while the dispenser is being used for the first time, it is necessary to separate the first-use safety element from the lid. Advantageously, the body forms two tapering side edges, the lid comprising a bottom edge face, the first-use safety element extending from the bottom edge face substantially parallel to one of two tapering side edges.

According to another characteristic of the invention, a flap is attached to the pouch and extends above the lid in such a manner as to prevent said lid from pivoting from its closed position.

Advantageously, the flap is attached to the pouch on either side of the stopper member and includes a notch in which the lid is arranged. The lid is indeed arranged in the notch, but it is impossible to actuate it as a result of the small size of the notch. It can be said that the notch surrounds the lid.

Advantageously, the lid pivots in a plane, the flap extending in said plane above the lid preventing it from pivoting, the flap being movable out from the plane so as to release the lid, the flap advantageously being hinged on the pouch and being formed by the two flexible sheets connected together. The flap may further include a suspension slot making it possible to hang the dispenser on a pin of a display.

The invention thus provides a dispenser having a flexible pouch that is particularly flat, while having a stopper-and-dispenser member that includes a pivoting lid, optionally provided with a first-use safety element that is sealed to the pouch, and a flap that is connected to the pouch and that prevents the lid from pivoting. It should be observed that the lid pivots in the plane of the dispenser that is essentially defined by the two flexible sheets of the pouch.

BRIEF DESCRIPTION OF THE DRAWINGS

The invention is described more fully below with reference to the accompanying drawings, which show an embodiment of the invention by way of non-limiting example.

In the figures.

DETAILED DESCRIPTION

Figure 1:
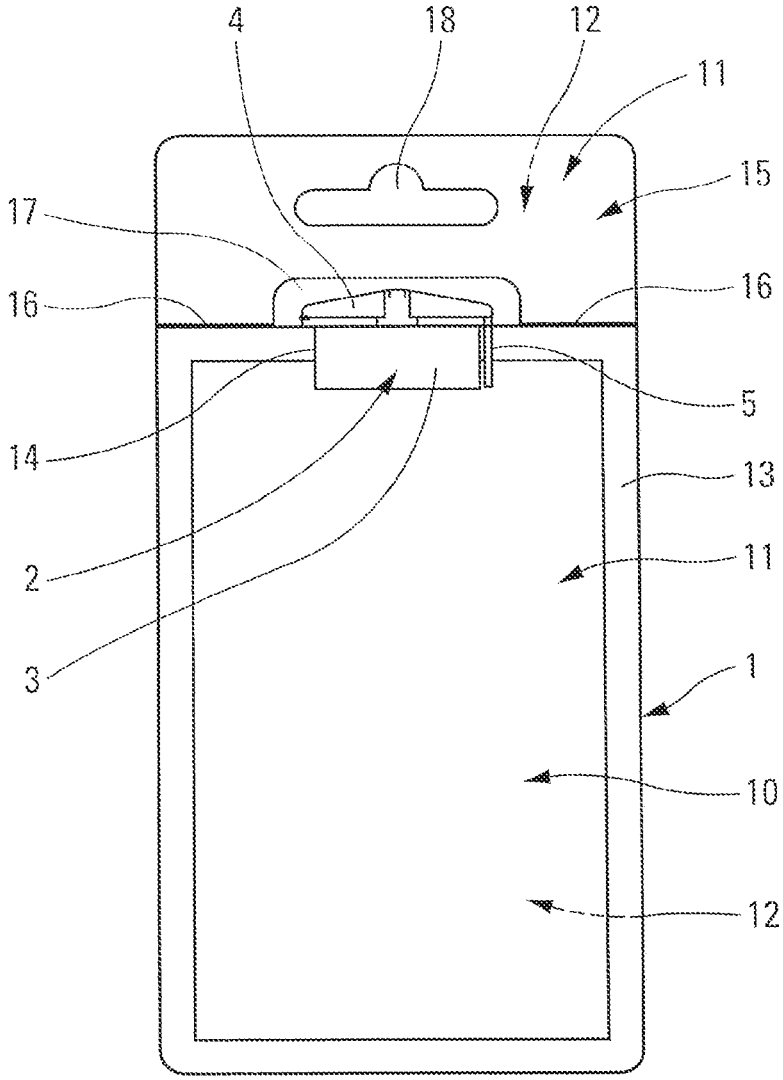
FIG. 1 is a plan view of a fluid dispenser of the invention before first use.

Reference is made firstly to FIG. 1 in order to describe in general the structure of a fluid dispenser made in accordance with the invention. The dispenser comprises two essential component elements, namely: a fluid reservoir 10; and a stopper-and-dispenser member 2 that is suitable for dispensing the fluid stored in the fluid reservoir 10. Optionally, the dispenser includes a flap 15 that is preferably associated with the fluid reservoir 10.

The fluid reservoir 10 is constituted by a flexible pouch 1 that comprises two flexible sheets 11, 12 that are connected together at their outer peripheries 13, except at an opening 14. By way of example, the two flexible sheets 11, 12 may be formed from a laminate of aluminum and plastics material. The two sheets 11, 12 are preferably assembled together by heat-sealing. The opening 14 is closed by the stopper-and-dispenser member 2, the detailed structure of which is described below. By way of example, the flexible sheets 11, 12 may be sealed on the stopper-and-dispenser member 2 by a heat-sealing technique. The sealing of the stopper-and-dispenser member 2 is preferably permanent, and naturally leaktight. The structure, the shape, and the composition of the flexible pouch are not critical to the present invention. Consequently, another type of flexible pouch may be used without going beyond the ambit of the present invention, providing the flexible pouch includes an opening defined by the two flexible sheets and in which the stopper-and-dispenser member 2 may be mounted in stationary, permanent, and leaktight manner.

Figure 2A:
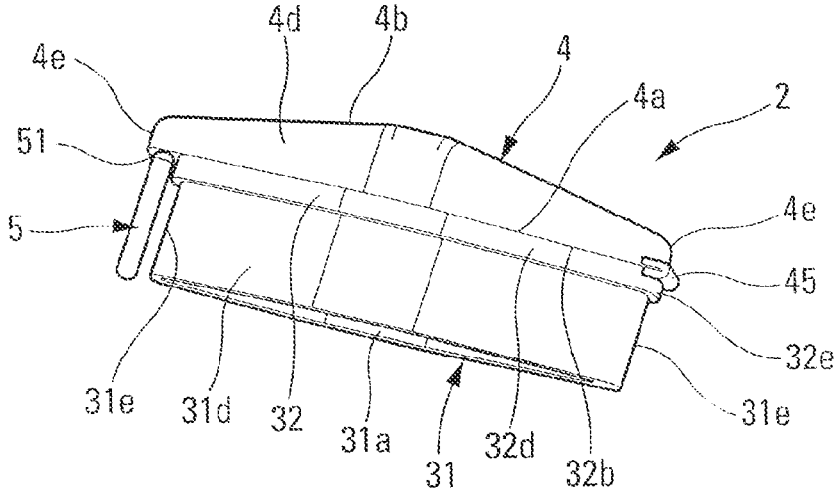
FIG. 2*a* is a much larger-scale perspective view of the stopper-and-dispenser member used in the FIG. 1 dispenser, in its closed state.
Figure 2B:
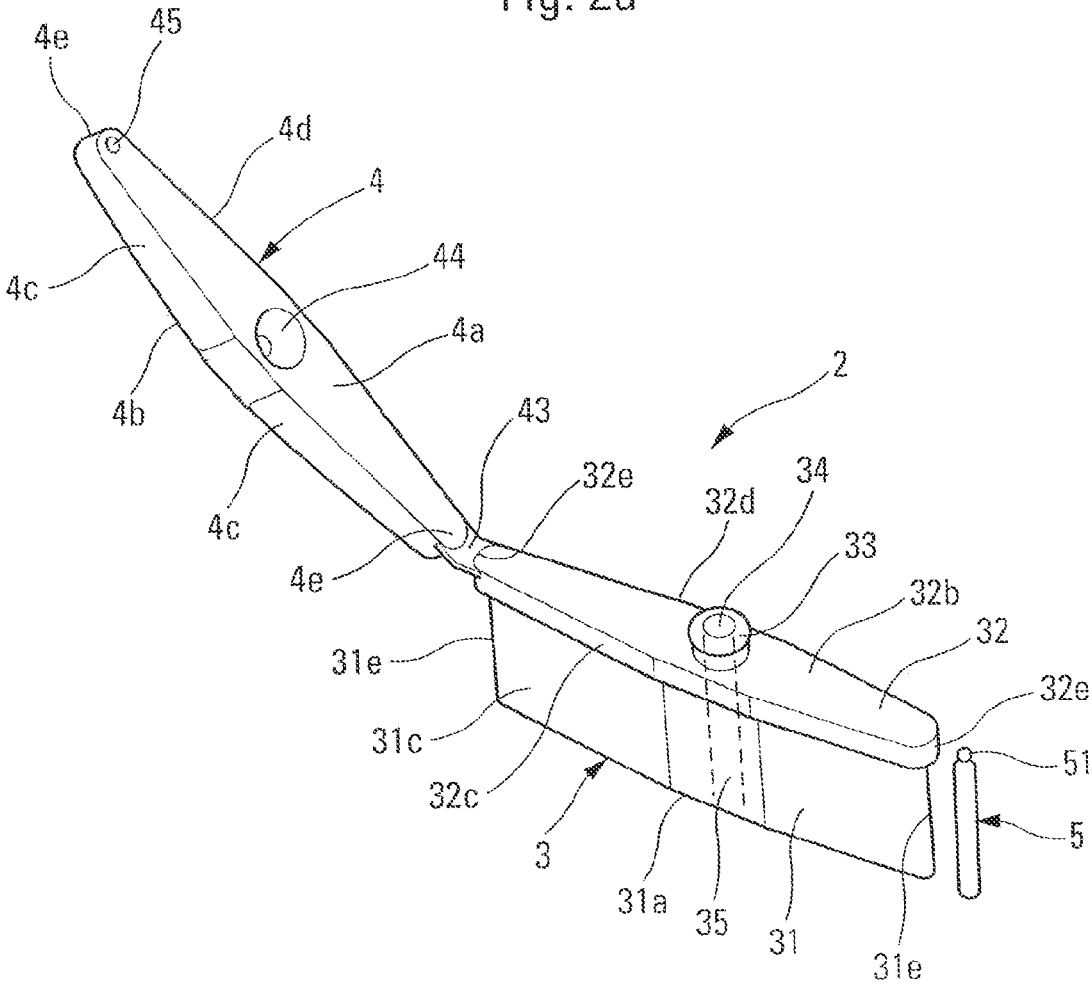
FIG. 2*b* is a view similar to the view in FIG. 2*a* with the stopper-and-dispenser member in its open state.

The stopper-and-dispenser member 2 constitutes the central element of the present invention. As described above, the stopper-and-dispenser member 2 is sealed in leaktight manner in the opening 14 of the flexible pouch 1. With reference more particularly to FIGS. 2*a* and 2*b*, it can be seen that the member 2 comprises a body 3 and a closure lid 4 that is connected to the body 3 via a hinge 43, such that the lid 4 is movable by pivoting relative to the body 3. Optionally, the member 2 also comprises a first-use safety element 5 that is initially connected to the lid 4.

The body 3 of the member 2 forms a sealing section 31 that is surmounted by an elongate bar 32. The sealing section 31, like the elongate bar 32, presents an elongate shape that is comparable to an eye or a flat lozenge. In other words, the thicknesses of the sealing section 31 and of the bar 32 is greater at their middle portions. The sealing section 31 forms two sealing zones 31*c* and 31*d* that extend over all or part of the two opposite main faces of the sealing section 31. The two sealing zones 31*c* and 31*d* are joined together at tapering side edges 31*e*. The bottom face of the sealing section 31 forms a bottom edge face 31*a* that is oriented towards the inside of the reservoir 10. The bar 32 is arranged on the sealing section 31 remote from the bottom edge face 31*a*. The bar 32 may advantageously project outwards relative to the sealing section 31. As a result, the dimensions of the bar 32 are a little greater than the dimensions of the sealing section 31, and a shoulder is thus formed at their junction. The bar 32 forms an external edge face 32*b* that is remote from the internal edge face 31*a*. The external edge face 32*b* is bordered by two longitudinal side edges 32*c* and 32*d* that are joined together at two opposite ends 32*e*. On its external edge face 32*b*, the bar 32 is provided with a projecting stud 33 through which there passes a dispenser orifice 34 that is extended into the sealing section 31 by an outlet channel 35 having an inlet that is situated at the internal edge face 31*a*. In other words, the outlet channel 35 passes through the body 1 from the internal edge face 31*a* to the external edge face 32*b* at the stud 33.

At the outlet channel 35, the thickness of the sealing section 31 is of the order of a few millimeters, e.g. 3 millimeters (mm) to 5 mm. The width of the sealing section 31 is about 2 centimeters (cm) to 4 cm, and its height is about 1 cm to 2 cm, for example. The dimensions of the bar 32 are a little greater than the dimensions of the sealing section 31: the width of the bar 32 may be about 4 mm to 6 mm, for example.

The body 3 of the member 2 is arranged in the opening 14 of the pouch 1 with the sealing section 31 arranged in contact with the two sheets 11 and 12. The bar 32 is arranged outside the opening and may come to bear on the edges of the sheets 11 and 12. The sheets 11 and 12 may thus be sealed at the sealing section 31, e.g. by heat-sealing. It should be observed that the body 3 extends in the same plane as the two sheets 11 and 12. Thus, the total thickness of the dispenser is determined by the width of the bar 32, i.e. about 5 mm.

The closure lid 4 is hinged on the bar 32 via a bridge of flexible material 43 that is connected to one end 32*e* of the bar 32. The bridge of material 43 may extend at the external edge face 32*b* of the bar 32. The lid 4 presents a general configuration that is substantially similar to the configuration of the bar 32, such that the lid 4 may cover all of the external edge face 32*b* of the bar 32. The lid 4 includes a bottom edge face 4*a* that is for coming to be positioned in manner adjacent to the external edge face 32*b* of the bar 32, when the lid is closed on the body. To do this, the bottom edge face 4*a* includes a recess 44 for receiving the stud 33 in leaktight manner, so as to close the dispenser orifice 34. The recess 44 may even be provided with pin for inserting in the orifice 34. The lid 4 also includes two side edges 4*b* and 4*d* that present profiles that are similar or identical to the side edges 32*c* and 32*d* of the bar 32. In the closed position, the edges 4*c*, 4*d* are in alignment with the edges 32*c*, 32*d*. One end 4*e* of the lid 4 that is connected to the bar 32 via the flexible bridge 43 is for coming into alignment with one of the ends 32*e* in the closed position, as shown in FIG. 2*a*. In contrast, the opposite other end 4*e* of the lid 4 projects outwards relative to the other end 32*e*, as can be seen in FIG. 2*a*. The first-use safety element 5 is connected to the lid 4 at this location, in such a manner as to extend substantially parallel to a tapering edge 31*e*, as can be seen in FIG. 2*a*. The safety element 5 may be in the form of a tab, a rod, a leaf, a stem, etc. that is connected to the bottom edge face 4*a* in the proximity of the free end 4*e*, at 45. The safety element 5 may be formed with a frustoconical breakable connection end 51 that forms a rupture zone. During first use, the lid 4 is opened, as shown in FIG. 2*b*, thereby separating the safety element 5 from the lid 4 in which there remains a trace at 45. The safety element 5 is for sealing between the two sheets 11 and 12 of the pouch while the closure member 2 is being sealed between the two sheets. In a variant, It is also possible to seal the safety element 5 to the body 3, e.g. at the bar 32 or at the tapering edge 31*e*. The solution that is shown in the figures consists in sealing the safety element 5 between the two sheets 11 and 12 of the pouch.

The lid 4 also includes a top edge face 4*b* that may be a little convex, as can be seen in FIG. 2*a*. The fact that one end 4*e* of the lid 4 projects relative to the adjacent end 32*e* of the bar also makes it easier to engage the lid 4, e.g. by means of a finger nail, so as to separate it from the body 3 and cause it to pivot.

It should be observed that the closure lid 4 pivots in the plane defined overall by the two sheets 11 and 12 of the pouch 1. Thus, when the user wishes to use the dispenser of the invention for the first time, the user begins by engaging the lid 4 and exerting traction, seeking to separate it from the body 3. The user must exert sufficient traction to break the connection between the safety element 5 and the lid 4. Once the connection has been broken, the lid may pivot, thereby uncovering the dispenser orifice 34. The user may then squeeze on the sheets 11 and 12 so as to force the fluid through the outlet channel 35 and the dispenser orifice 34 where the user may collect the fluid. After dispensing, the user may close the dispenser by pivoting the lid 4 back in such a manner as to cover the dispenser orifice 34 once again.

Figure 3B:
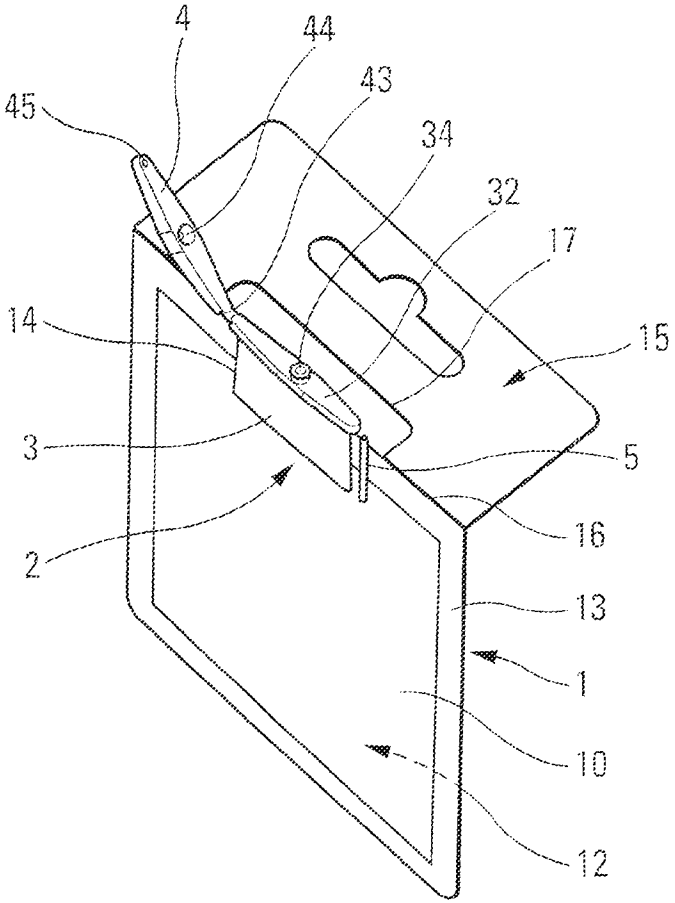
FIG. 3*b* is a view similar to FIG. 3*a* with the lid in its open position.
Figure 3A:
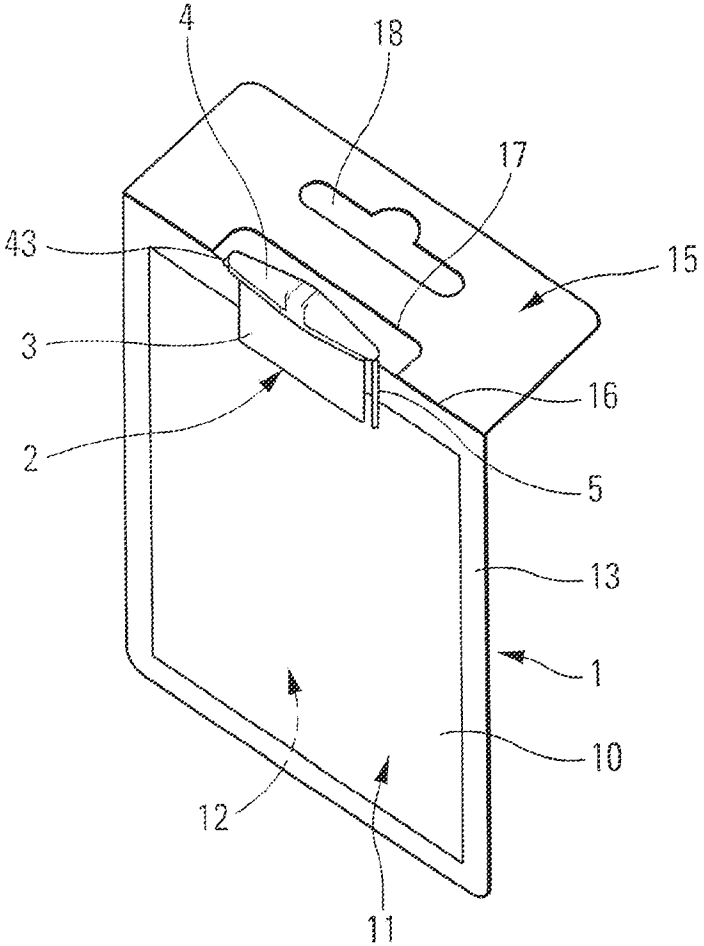
FIG. 3*a* is a perspective view of the FIG. 1 dispenser, just before the lid of the stopper-and-dispenser member is opened.

In an advantageous embodiment of the invention, the flap 15 initially extends in the plane of the dispenser, i.e. upwards in register with the sheets 11 and 12. Preferably, the flap 15 is made from the sheets 11 and 12, in the form of an extension. The sheets 11 and 12 may quite simply be connected together, e.g. by heat-sealing. The flap 15 is connected to the pouch 1 at two lines 16 that extend on either side of the stopper-and-dispenser member 2, as can be seen in FIGS. 1, 3*a*, and 3*b*. Given that the lid 4 and also the bar 32 project out from the opening 14, the flap 15 defines, at this location, a notch 17 that is occupied by the lid 4. This is shown clearly in FIG. 1. As a result, it is not possible to pivot the lid 4, since it is covered by the notch 17. It should also be observed that the flap 15 is provided with a suspension slot 18 for hanging it on a pin of a presentation display.

Thus, when the flap 15 extends in the same plane as the pouch 1, it is impossible to open the lid 4. However, by deforming or pivoting the flap 15 out from the plane of the pouch 1, e.g. at the lines 16, as shown in FIGS. 3*a* and 3*b*, it is thus possible to actuate the lid 4, i.e. to move it by pivoting it in the same plane as the pouch 1, as shown in FIG. 3*b*. The user may then dispense the fluid through the dispenser orifice 34. After use, the lid 4 may be returned to its closed position on the dispenser orifice 34, and the flap 15 may be returned into the same plane as the pouch 1, once again thus preventing the lid 4 from being opened.

The flap 15 thus prevents the lid 4 from being opened, and simultaneously protects it from being opened unintentionally or accidentally. In addition, after each use, the flap 15 may be returned above the lid 4 so as to prevent said lid from being actuated, thereby providing a repeatable locking function.

The combination of the flap 15 (pivoting out from the plane of the pouch 1) and of the lid 4 (pivoting in the plane of the pouch 1) is particularly advantageous, since it makes it possible to obtain a dispenser having a dispenser orifice that can be closed easily and repeatedly, while guaranteeing that the lid is locked between each use. The presence of a first-use safety element 5 connected to the lid 4 and sealed to the pouch 1 or to the body 3 is also advantageous, since it does not complicate in any way the molding operation, nor the operation of assembling the member 2 in the opening 14 of the pouch 1.

Figure 4B:
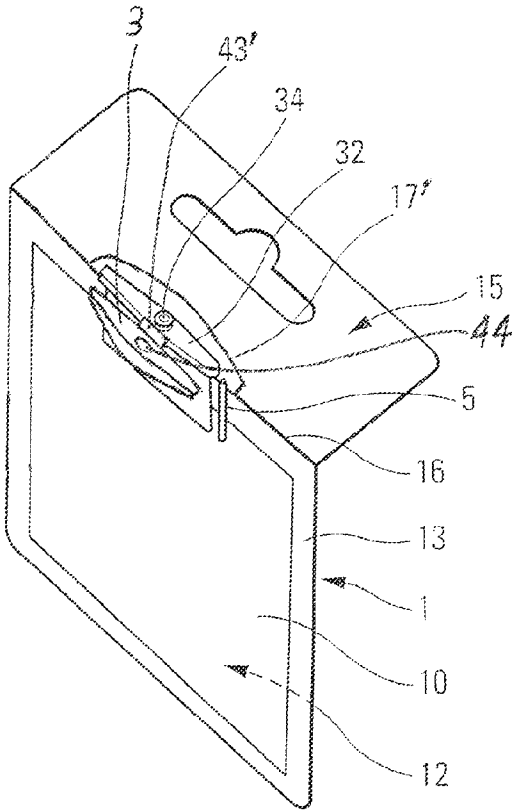
FIG. 4*b* is a view similar to that one of FIG. 3*b* for the alternative embodiment of FIG. 4*a*.
Figure 4A:
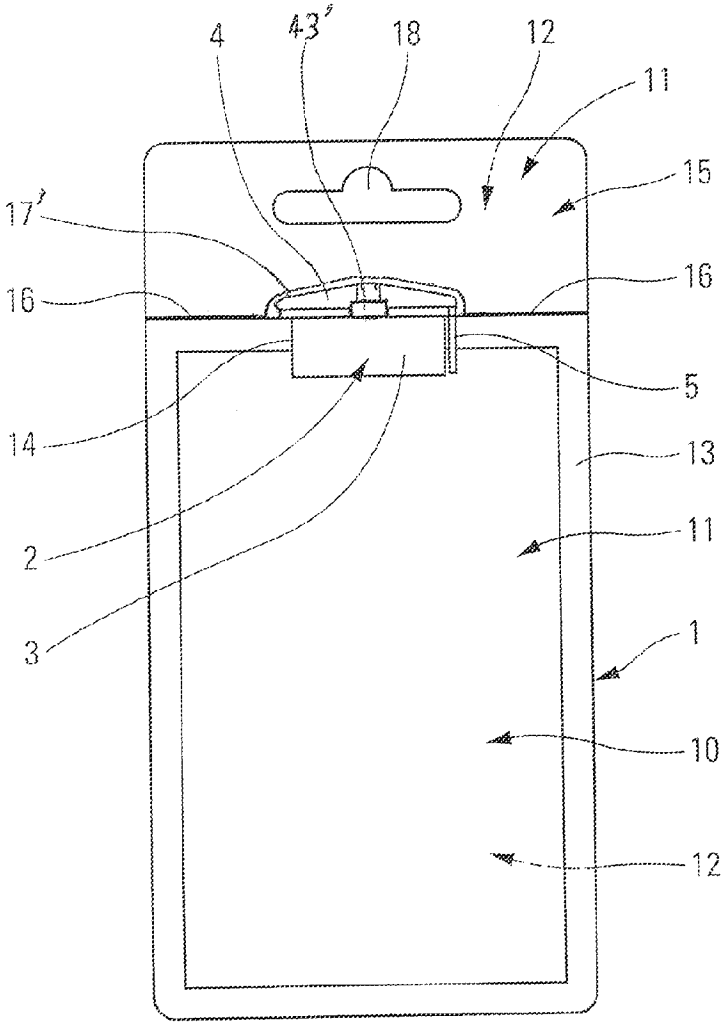
FIG. 4*a* is a view similar to that one of FIG. 1 for an alternative embodiment.

FIGS. 4*a* and 4*b* show an alternative embodiment wherein the body 3 and the lid 4 may be identical or similar to those of the preceding figures. However, the lid 4 is connected to the body 3 by a lateral flexible bridge 43' which is located at one of the longitudinal side edges (32*c*, 32*d*) of the body, advantageously between the orifice 34 and the recess 44. Thus, the lid 3 pivots out of the plane of the pouch, as it may be seen in FIG. 4*a*. In order to protect the lid 4, the notch 17' is reduced in such a manner as to surround the upper shape of the lid with a small gap, as it is visible in FIG. 4*a*.

What is claimed is:

1. A fluid dispenser comprising:

a flexible pouch that comprises two flexible sheets that define between them a fluid reservoir and an opening; and a stopper-and-dispenser member that is mounted in stationary, permanent, and leaktight manner in the opening of the pouch, the stopper member including a body that defines a dispenser orifice, an outlet channel that connects the reservoir to the dispenser orifice, and two sealing zones, respectively, to connect the stopper member to the two flexible sheets of the pouch;

the stopper-and-dispenser member further includes a lid for closing the dispenser orifice, the lid being hinged on the body in such a manner as to pivot between a closed position and an open position, wherein the lid is provided with a first-use safety element that is initially connected to the lid before the stopper member is opened for the first time, and that is separated from the lid while the stopper member is being opened for the first time, the safety element being sealed to the pouch while the stopper member is being sealed in the opening of the pouch.

2. The dispenser according to claim 1, wherein the body forms two tapering side edges, the lid comprising a bottom edge face, the first-use safety element extending from the bottom edge face substantially parallel to one of two tapering side edges.

3. The dispenser according to claim 1, wherein the body defines an internal edge face that is arranged inside the reservoir, and an external edge face, the outlet channel extending from the internal edge face to the external edge face in which the dispenser orifice is formed, the sealing zones extending between the two edge faces, the lid being hinged on the external edge face, the external edge face including two longitudinal side edges that are joined together at two opposite ends.

4. The dispenser according to claim 3, wherein, the lid is hinged at one of the two opposite ends.

5. The dispenser according to claim 3, wherein the lid is hinged at one of two longitudinal side edges.

6. The dispenser according to claim 1, wherein a flap is attached to the pouch and extends above the lid in such a manner as to prevent said lid from pivoting from its closed position.

7. The dispenser according to claim 6, wherein the flap is attached to the pouch on either side of the stopper member and includes a notch in which the lid is arranged.

8. The dispenser according to claim 6, wherein the lid pivots in a plane, the flap extending in said plane above the lid preventing the lid from pivoting, the flap being movable out from the plane so as to release the lid, the flap being hinged on the pouch and being formed by the two flexible sheets connected together.

9. The dispenser according to claim 6, wherein the flap includes a suspension slot for hanging the dispenser on a pin of a presentation display.

10. The dispenser according to claim 1, presenting a configuration that is generally flat, in such a manner as to occupy a plane.

11. The dispenser according to claim 1, wherein the safety element is sealed between the two flexible sheets of the pouch.

12. The dispenser according to claim 1, wherein the safety element is a tab and extends between the two flexible sheets of the pouch.

13. The dispenser according to claim 1, wherein the safety element extends between the lid and the two flexible sheets without being attached to the body.

14. The dispenser according to claim 1, wherein the safety element forms a rupture zone at a first end in contact with the lid.

15. The dispenser according to claim 14, wherein the rupture zone is formed by a frustoconical breakable connection at the first end of the safety element.

16. The dispenser according to claim 1, wherein the safety element remains attached to the pouch once the lid has been opened.

* * * * *